US010799840B2

(12) United States Patent
Blömer et al.

(10) Patent No.: US 10,799,840 B2
(45) Date of Patent: Oct. 13, 2020

(54) STIRRING MEMBER, STIRRING ROD ARRANGEMENT AS WELL AS TRANSPORT AND STORAGE CONTAINER FOR LIQUIDS HAVING A STIRRING MEMBER ARRANGEMENT

(71) Applicant: PROTECHNA S.A., Fribourg (CH)

(72) Inventors: Peter Blömer, Hennef (DE); Carsten Büsch, Altenkirchen (DE)

(73) Assignee: PROTECHNA S.A., Fribourg (CH)

( * ) Notice: Subject to any disclaimer, the term of this patent is extended or adjusted under 35 U.S.C. 154(b) by 195 days.

(21) Appl. No.: 15/751,619

(22) PCT Filed: Aug. 11, 2016

(86) PCT No.: PCT/EP2016/069116
§ 371 (c)(1),
(2) Date: Feb. 9, 2018

(87) PCT Pub. No.: WO2017/045846
PCT Pub. Date: Mar. 23, 2017

(65) Prior Publication Data

US 2018/0236419 A1 Aug. 23, 2018

(30) Foreign Application Priority Data

Sep. 18, 2015 (DE) ..... 10 2015 011 967

(51) Int. Cl.
*B01F 7/00* (2006.01)
*B01F 7/16* (2006.01)
*B01F 15/00* (2006.01)

(52) U.S. Cl.
CPC ..... *B01F 7/00066* (2013.01); *B01F 7/00158* (2013.01); *B01F 7/00541* (2013.01);
(Continued)

(58) Field of Classification Search
CPC ..... B01F 7/00066; B01F 7/00158; B01F 7/00541; B01F 7/1695; B01F 15/00681; B01F 2215/0422
See application file for complete search history.

(56) References Cited

U.S. PATENT DOCUMENTS 4,060,224 A * 11/1977 Wilson ..... B01F 7/00066 366/169.1
5,037,209 A * 8/1991 Wyss ..... B01F 7/00591 366/246

(Continued)

FOREIGN PATENT DOCUMENTS

CA 2644168 A1 5/2010
CN 102271794 A 12/2011

(Continued)

*Primary Examiner* — Anshu Bhatia
(74) *Attorney, Agent, or Firm* — King & Schickli, PLLC

(57) ABSTRACT

A stirring member (90) for an industrial stirrer, in particular for a stirring rod arrangement, for connecting to a stirring mechanism combinable with a container for receiving liquids, wherein the container comprises a filling opening closable with a lid for filling the container in an upper bottom wall, wherein the stirring member is connectable to a rod-shaped stirring member carrier of the stirring rod arrangement, wherein the stirring member comprises a bearing end (91) and a stirring member end (94) connected to the bearing end (91) via a link (92) and having a flow tube (93), wherein the flow tube comprises a tube wall, wherein the flow tube comprises an annularly formed accumulating surface (95) at its flow inlet cross section, wherein the accumulating surface comprises at least one circular ring sector (96) which is inclined with respect to an inflow plane of the flow inlet cross section.

14 Claims, 8 Drawing Sheets

(52) U.S. Cl.
CPC ..... *B01F 7/1695* (2013.01); *B01F 15/00681* (2013.01); *B01F 2215/0422* (2013.01)

(56) References Cited

U.S. PATENT DOCUMENTS

| | | | | |
|---|---|---|---|---|
| 7,665,887 | B2 | 2/2010 | Morris, Jr. et al. | |
| 8,876,369 | B1 | 11/2014 | Lott et al. | |
| 2011/0249529 | A1 | 10/2011 | Hirzel | |
| 2012/0261063 | A1 | 10/2012 | Schuetz | |
| 2013/0279289 | A1* | 10/2013 | Eggler ..... | B01F 7/00558 366/285 |

FOREIGN PATENT DOCUMENTS

| | | | |
|---|---|---|---|
| CN | 205797138 | U | 12/2016 |
| CN | 107405585 | A | 11/2017 |
| DE | 2420605 | A1 | 11/1975 |
| DE | 3901894 | A1 | 8/1989 |
| DE | 4343113 | A1 | 7/1994 |
| DE | 20214291 | U1 | 1/2003 |
| DE | 20216809 | U1 | 3/2004 |
| DE | 202005008676 | U1 | 10/2005 |
| DE | 2008005017 | B3 | 3/2009 |
| DE | 102008063393 | B3 | 6/2010 |
| DE | 102011051499 | A1 | 1/2013 |
| DE | 202014002901 | U1 | 4/2014 |
| EP | 2620210 | A1 | 7/2013 |
| SU | 1542601 | A1 | 2/1990 |
| WO | WO2016142090 | A2 | 9/2016 |

* cited by examiner

Fig. 10
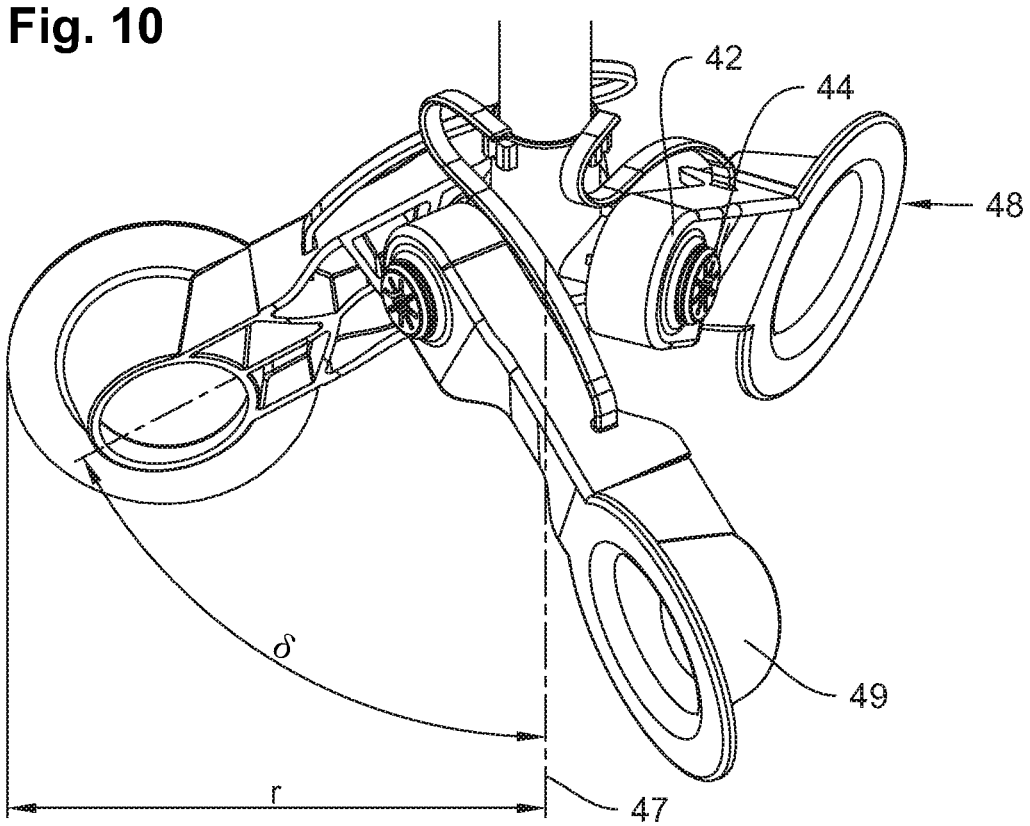
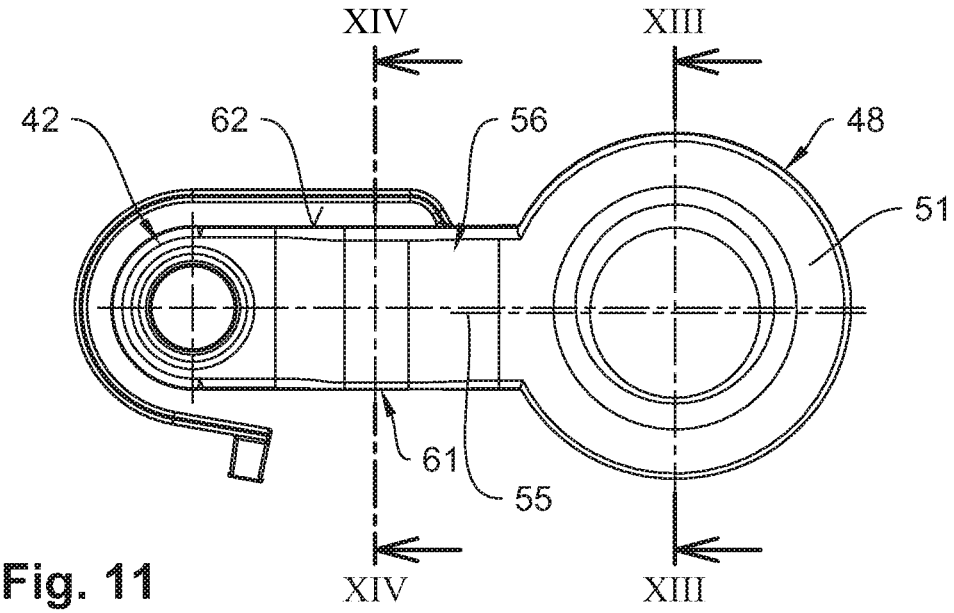
Fig. 11

STIRRING MEMBER, STIRRING ROD ARRANGEMENT AS WELL AS TRANSPORT AND STORAGE CONTAINER FOR LIQUIDS HAVING A STIRRING MEMBER ARRANGEMENT

FIELD OF THE INVENTION

The invention relates to a stirring member for an industrial stirrer, in particular for a stirring rod arrangement, for connecting to a stirring mechanism combinable with a container for receiving liquids, wherein the container comprises a filling opening closable with a lid for filling the container in an upper bottom wall, wherein the stirring member is connectable to a rod-shaped stirring member carrier of the stirring rod arrangement, wherein the stirring member comprises a bearing end and a stirring member end connected to the bearing end via a link or crosspiece, respectively, and having a flow tube, wherein the flow tube comprises a tube wall.

BACKGROUND OF THE INVENTION

A stirring member in a stirring rod arrangement of the make mentioned above is known from DE 20 2014 002 901 U1. The known stirring members of the stirring rod arrangement are pivoted against the stirring member carrier in a mounting configuration, in which the stirring rod arrangement can be inserted into in a container for receiving liquids, and are secured to the stirring member carrier in this position via a locking connection. The stirring members as such are pivotably mounted at a stirring member carrier at a bearing end and comprise a link starting from the bearing end, a flow tube being attached to the end of said link. The flow tube is cone-shaped and comprises a flow inlet cross section which is larger than the flow outlet cross section.

A stirring member is known from DE 10 2008 063 393 B3 which comprises an annular accumulating surface. The accumulating surface is arranged in an inflow plane of a flow inlet cross section of an opening of the stirring member. A flow tube is formed in the shape of a flange at the accumulating surface, i.e. the opening.

A disadvantage of the known stirring members is that depending on viscosity and flow behavior, a satisfactory mixing of the liquid to be mixed cannot be achieved. Simultaneously, it is desirable to realize a stable centering of the stirring members on a rotational path of the stirring rod arrangement.

SUMMARY OF THE INVENTION

The object of the invention at hand is to propose a stirring member and stirring rod arrangement which comprise improved mixing characteristics.

The object is attained by a stirring member having the features of claim 1, a stirring rod arrangement having the features of claim 11 and a transport and storage container having the features of claim 15.

The stirring member for an industrial stirrer, according to the invention, in particular for a stirring rod arrangement for connecting to a stirring mechanism combinable with a container for receiving liquids, wherein the container comprises a filling opening closable with a lid for filling the container in an upper bottom wall, is connectable to a rod-shaped stirring member carrier of the stirring rod arrangement, wherein the stirring member comprises a bearing end and a stirring member end connected to the bearing end via a link or crosspiece, respectively, and having a flow tube, wherein the flow tube comprises a tube wall, wherein the flow tube comprises an circularly formed accumulating surface at its flow inlet cross section, wherein the accumulating surface comprises at least one circular ring sector which is inclined with respect to an inflow plane of the flow inlet cross section.

By means of the circularly formed accumulating surface, which comprises at least one circular ring sector inclined with respect to an inflow plane of the flow inlet cross section, an additional force acting on the stirring members can be generated at a defined position, said force serving to influence a relative movement of the stirring member end in the flow environment. Simultaneously, the circularly formed accumulating surface enables a very good mixing of a liquid to be mixed, since a swirling of the liquid is realized. Simultaneously, the force produced at the stirring member via the inclined circular ring sector can stabilize or center the stirring member insofar that a steady and low-vibration rotation of the stirring rod arrangement is possible on a rotational path despite the swirling produced in the liquid to be mixed via the accumulating surface.

In an embodiment of the stirring member, it can be provided that the inclined circular ring sector extends over at least 90°, preferably at least 180°, particularly preferably at least 270°, of the accumulating surface based on an circular ring center. Depending on the viscosity and flow behavior of the liquid to be mixed, the inclined circular ring sector can be adjusted accordingly to the mixing task. The inclined circular ring sector can be arranged opposite a contact surface or level partial surface, respectively, of the link, based relatively on the circular ring center.

Furthermore, the accumulating surface can comprise at least one surface sector inclined at a surface sector angle $\zeta$ with respect to a level partial surface of the accumulating surface, wherein the surface sector angle $\zeta$ can preferably be 10°. The surface sector can then be formed levelly, for example. The surface sector angle $\zeta$ can also be 5° or up to 20°, for example.

In another embodiment of the invention, the inclined circular ring sector can extend over more than 360° of the accumulating surface based relatively on an circular ring center. Consequently, the entire accumulating surface can be inclined with respect to the inflow plane of the flow inlet cross section.

The circular ring sector can also be inclined at a surface sector angle $\zeta$, wherein the surface sector angle can be formed consistently. Thus, the accumulating surface can be cone-shaped or funnel-shaped, wherein the accumulating surface forms a comparatively flat cone as a type of funnel with respect to the flow tube. A surface sector angle $\zeta$ of the cone can be 5° to 20°, preferably 10°. The surface sector angle $\zeta$ is measured at an edge of the circular ring sector and can vary by +/−1°.

Furthermore, the circular ring sector can be inclined by a surface sector angle $\zeta$, wherein the surface sector angle is continuously changed along the circular ring sector according to a non-linear, preferably trigonometric, function, wherein sections of the surface sector angle $\zeta$ can be at least 5° to 20°, preferably 10°. Such a function can, for example, be a sine function, so that the circular ring sector can be formed wavelike in its radial progression. By means of this wavelike design of the circular ring sector, a better centering of the stirring member can be realized.

The circular ring sector can also be tilted by a surface sector angle $\zeta$, wherein the surface sector angle can increase steadily relative to an circular ring center or an circular ring center axis, respectively, with a decreasing distance of the accumulating surface. The surface sector angle ζ can consequently be formed steady, linearly variable, for example, relative to the circular ring center or relative to an outer edge plane formed by an outer edge of the accumulating surface, so that a possibly improved inflow behavior of liquid into the flow tube is enabled. The surface sector angle ζ can be 5° to 20°, preferably 10°, to the outer edge plane at the outer edge of the accumulating surface.

The accumulating surface can be formed as a bell-shaped opening, for example. The opening can be formed as either a trumpet-shaped or bugle-shaped opening, wherein a possibly laminar flow within the flow tube can be thusly achieved, which favors a low-vibration rotation of stirring members.

In another advantageous embodiment of the invention, the circular ring sector can be inclined by a surface sector angle ζ, wherein the surface sector angle can be continuously changed according to a non-linear, preferably trigonometric, function as the distance of the accumulating surface relative to an circular ring center changes, wherein sections of the surface sector angle ζ can be 5° to 20°, preferably 10°. The circular ring sector can then be continuously changed in the type of a wave starting from the circular ring center.

Accordingly, the accumulating surface can be formed as a wavelike opening. The circular ring sector can form, for example, several sine-shaped waves.

If the tube wall is formed in such a way that the length of the tube wall in a cut perpendicular to the longitudinal axis of the link above a tube axis is larger than below the tube axis, a surface profile longer in the flow direction is formed above the tube axis than below the flow axis, so that the lift force acting on the stirring member ends is increased and a stabilizing of the stirring member ends in the liquid flow is consequently realized during operation.

If, in addition, a surface base of a lift surface formed by an upper part of the tube wall is inclined at an angle of attack to the inflow direction, a desired lift force can be adjusted at the stirring member ends by choosing the angle of attack as a function of the rotational speed of the stirring rod arrangement. Thus, it is possible, for example, to carry out a special adjustment of the stirring rod arrangement to the viscosity or other material consistency of the liquids to be mixed via an adequately chosen angle of attack.

Preferably, the tube wall is formed as a slanted cone in such a way that a flow inlet cross section of the flow tube is inclined to a flow outlet cross section of the flow tube under a tube angle, so that an influencing of the lift force is possible here as well.

If the flow tube comprises the accumulating edge having the circularly formed accumulating surface at the flow inlet cross section, the accumulating surface abutting to a link surface of the link, a desired flow resistance of the stirring member can also be adjusted depending on the embodiment and size of the accumulating surface.

It is particularly advantageous if the accumulating surface is inclined by an accumulating surface angle in the inflow direction with respect to the rotational axis, so that the flow resistance is adjustable via the accumulating surface angle disregarding the surface size of the accumulating surface.

If a lift pocket is formed in a middle section of the link or crosspiece, respectively, said lift pocket having a lift surface inclined by an inclination angle in the flow direction with respect to the rotational axis and inclined at an angle of attack with respect to the inflow direction, the lift behavior or the flow resistance behavior, respectively, of the stirring member can be influenced by a corresponding design of the link surface via an adequately chosen angle.

The stirring rod arrangement, according to the invention for an industrial stirrer, in particular for connecting to a stirring mechanism combinable with a container for receiving liquids, wherein the container comprises a filling opening closable with a lid for filling the container in an upper bottom wall, comprises a rod-shaped stirring member carrier formed as a hollow shaft for receiving a stirring mechanism shaft, wherein the stirring rod arrangement comprises stirring members pivotably connected to the stirring member carrier according to the invention. In an operational configuration, the stirring members can then take up a pivoted position at a stirring angle δ with respect to the rotational axis in consequence of a rotation of the stirring member carrier, the pivoted position being dependent on the rotational speed of the stirring member carrier, in such a way that the free stirring member ends are arranged in a stirring member distance r from the rotational axis. Further advantageous embodiments of a stirring rod arrangement can be found in the dependent claims of claim 1.

In a mounting configuration, a free stirring member end of the stirring members can be pivoted against a rotational axis of the stirring member carrier, wherein a spring device can be arranged between the stirring members and the stirring member carrier in such a way that a centrifugal force is applied to the stirring members in an operational configuration in consequence of a rotation of the stirring member carrier and the stirring members take up a pivoted position, which is dependent on the rotational speed of the stirring member carrier, at an angle δ formed with respect to the rotational axis, wherein the free stirring member ends are arranged in a stirring distance r from the rotational axis and the spring force acts against the centrifugal force, the spring force becoming stronger as the stirring angle increases. Accordingly, an automatic upward pivoting of the stirring members can take place in such a way that the stirring member ends are pivoted upward in consequence of the centrifugal force acting on the stirring member ends and are arranged in a stirring distance from the rotational axis when the stirring rod arrangements are in operation. Thereby, it is not only possible to carry out the adjustment of the stirring members from the mounting configuration to the operational configuration without manual intervention. Furthermore, the desired distance of the stirring member ends to the stirring member carrier can be adjusted via an adequately chosen rotational frequency. The spring force acts as a restoring force which counteracts the centrifugal force and causes a restoring of the stirring member ends against the rotational axis when the rotational speed is decreasing. Thereby, in particular residual amounts of the liquid in the container, which accumulate in a narrowed bottom region of the container, can be stirred, without the risk of the stirring member ends colliding with the container wall. The restoring spring action also has the effect that even stirring members of a low-density material do not float in a liquid of comparable density but instead are active in a desired stirring depth in the liquid.

It is particularly advantageous if the free stirring member ends of the stirring member are arranged beneath pivot bearings formed at the stirring member carrier in the mounting configuration, since consequently the stirring members can be directly pivoted against each other in the mounting configuration, so that the cross section essential for the insertion of the stirring rod arrangement via the filling opening of the container into the container is made as small as possible in the area of the stirring members pivoted against each other.

If the spring device is formed as a leg spring, the cross section minimization mentioned above in particular can be supported, since the leg spring is installable on the stirring members so as to be located radially outside while radially protruding as little as possible. Preferably, a leg of the leg spring is supported above the pivot bearing at the stirring member carrier and the other leg of the leg spring supports itself at the stirring member.

In another preferred embodiment of the invention, the spring device is formed as a spiral spring, which requires an installation space as small as possible. For example, an end of the spiral spring can be arranged at a pivot pin of the pivot bearing and the other end can be arranged at the stirring member.

If the spring device is formed as an electrically conductive connection between the stirring member carrier and the stirring member, a safe electrostatic discharge, which is independent to the formation of the pivot hearing, can take place from the liquid to be mixed via the stirring members into the stirring member carrier.

It is particularly advantageous if the spring device is made of an electrically conductive plastic, wherein all components of the stirring rod arrangement can be made of plastic, preferably an electrically conductive plastic, in a particularly preferred embodiment of the invention. The stirring member as such can therefore be injected in one piece, for example as an injection molding piece, made of electrically conductive plastic.

If the spring device is formed out of a material extension formed at the stirring member, it is possible to form the spring device together with the stirring member in one single process step, for example an injection molding step. Moreover, an integral connection between the spring device and the stirring member is thereby realized, so that special, separately formed linking devices are not necessary.

This is also the case for the connection of the spring device with the stirring member if the spring device is connected in a form fitting manner with a free connection end, for example via a locking connection, to the stirring member carrier.

Independently from the arrangement of the spring device at the stirring rod arrangement, it is also advantageous if the stirring members, in a stirring rod arrangement of the make mentioned above, are made of electrically conductive plastic.

Preferably, the stirring member carrier comprises a connection device for connecting the lid at its upper axial end, wherein the connection device comprises an axial abutment for contacting against a supporting edge formed in the bottom of a plug depression formed in the lid for receiving a drum plug, said supporting edge limiting a through link opening formed in the bottom. By this means, it is possible for the stirring rod arrangement to also be connected with the container by means of the lid independently of a stirring mechanism combined with the stirring rod arrangement. Thereby, the stirring rod arrangement can also be arranged, or remain, at a container without a stirring mechanism having to necessarily be coupled with the stirring rod arrangement.

The aforementioned advantageous embodiment of the stirring rod arrangement having the connecting device arranged at its upper axial end thereby proves to be advantageous independent of the remaining design of the stirring member carrier, also in particular independent of whether a spring device is arranged between the stirring members and the stirring member carrier and in particular also independent of how the stirring members are designed.

If the abutment of the connecting device described above is formed by a circlip received in a circlip receiver of the connecting device, this circlip can have a particularly simple design on the one hand and the embodiment of the abutment as a circlip which abuts on the supporting edge enables a rotational movement between the stirring rod arrangement and the lid if necessary, on the other hand. Preferably, the circlip abuts on the supporting edge only during a standstill of the stirring rod arrangement, whereas the circlip is lifted off of the supporting edge during a rotation of the stirring rod arrangement with respect to the lid in order to avoid friction and abrasions in particularly caused by friction and thus possible impurities of the liquid received in the container.

Preferably, the circlip receiver is formed as a separate component which is connected to the stirring member carrier in a form-fitting manner in order to form the connecting device.

Alternatively, however, it is also possible to integrally form the circlip receiver with the stirring member carrier.

It is particularly preferred if the circlip receiver is formed by a material extension formed at the stirring member carrier, said material extension being produced by a reshaping method at the contour of the stirring member carrier, for example.

If the stirring member carrier comprises a connecting device, formed at the lower axial end as a shaft hub, for connecting the stirring members, wherein the connecting device is connected in a form-fitting manner to the stirring member carrier and comprises bearing pins for connecting to the stirring members and for forming pivot bearings, the stirring member carrier can be designed particularly simply and the comparatively complexly formed connecting device can be produced separately. The forming of the connecting device at the stirring member carrier can then be carried out by simply producing the form-fitting connection between the connecting device and the stirring member carrier.

It is particularly advantageous if the connecting device simultaneously serves to connect the stirring mechanism shaft of the stirring mechanism.

If the connection of the connecting device to the stirring mechanism shaft is formed in a form-fitting manner, this connection can also be carried out in a simple manner without the use of tools.

Preferably, the connecting device comprises a first form-fitting linking device for transferring the turning moment of the stirring mechanism shaft onto the stirring members and a second linking device for axially securing the connecting device onto the stirring mechanism shaft, so that not only a safe transferal of the turning moment from the stirring mechanism shaft onto the stirring rod arrangement can be carried out by a form-fitting linking device, but additionally the axial securing of a defined axial relative position between the stirring mechanism shaft and the stirring rod arrangement via a form-fitting linking device is carried out as well.

Preferably, the stirring rod arrangement is formed in such a way that it is connected to the lid and can be inserted into a filling opening of a container as a mounting unit together with the lid and can be connected to the container by means of a connection of the lid to the filling opening of the container, so that a stirring rod arrangement and a container can be combined in such a manner that the combination is secured to the container by simply replacing the lid standardly arranged on the filling opening of the container with a lid connected as a mounting unit to the stirring rod arrangement.

Preferably, the lid is provided with a drum plug arranged in a plug depression of the lid for securing the connection of the lid to the stirring rod arrangement and for forming a captive linking of the lid to the stirring rod arrangement in such a way that the circlip is received in a circlip receiver space, axially defined on both sides, of the stirring rod arrangement formed as a mounting unit.

The invention at hand also relates particularly to a transport and storage container for liquids having a container formed as an internal container made of plastic, said container comprising a filling opening closable with a lid for filling the container in an upper bottom wall, and an outlet connection arranged at the front side for connecting an outlet fitting, as well as a lower bottom wall connecting two lateral walls, a rear wall and a front wall of the container for supporting the container on a pallet floor of a transport pallet having an outer jacket for receiving the container, wherein the lid of the container is provided with a stirring rod arrangement according to the advantageous embodiments of the invention described above.

BRIEF DESCRIPTION OF THE DRAWING FIGURES

In the following, the invention is further described by means of the drawings.

In the figures:

FIG. 10 shows the arrangement of stirring members illustrated in FIG. 8 in an operational configuration;

FIG. 11 shows an individual stirring member not according to the invention in top view;

DETAILED DESCRIPTION OF THE INVENTION

Figure 1:
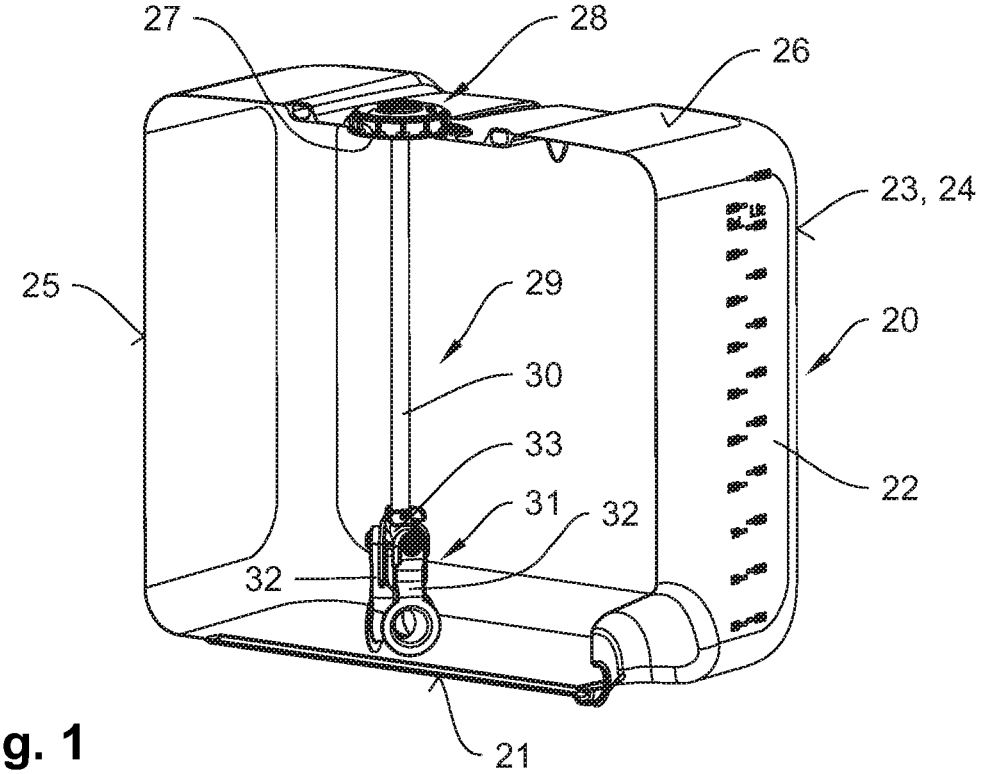
FIG. 1 shows a longitudinal cross sectional view through a container usable as an internal container for a transport and storage container for liquids having a stirring rod arrangement not according to the invention in a mounting configuration.

FIG. 1 shows a container 20 for receiving liquids formed as an internal container for a not further illustrated transport and storage container. The container 20 comprises a front wall 22 connected to a lower bottom wall 21 meant to serve as a support on a not further illustrated pallet floor of a transport pallet, which is provided with a grid jacket, also not further illustrated, for receiving the container 20, two opposing lateral walls 23, 24, a rear wall 25 as well as an upper bottom wall 26 opposite the lower bottom wall 21.

The upper bottom wall 26 is provided with a filling connection 27 closable with a lid 28 formed a screw-on lid in this case.

In the illustrated embodiment, the lid 28 forms a component of a stirring rod arrangement 29, the latter comprising as essential components a stirring member carrier 30 formed as a hollow shaft made of electrically conductive plastic in the case at hand as well as a stirring rod arrangement 31, which comprises three stirring members 32 in the case of the embodiment at hand, said stirring members connected to the stirring member carrier 30 by means of a shaft hub 33.

Figure 8:
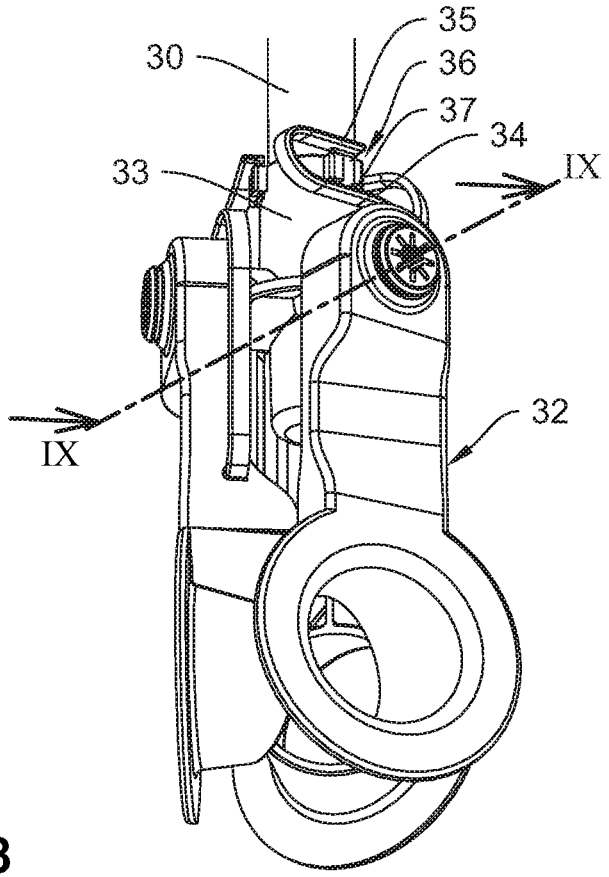
FIG. 8 shows the lower axial end of the stirring rod arrangement illustrated in FIG. 1 in an enlarged view having a plurality of stirring members.

As in particular a synopsis of FIGS. 1, 8 and 10 shows, spring devices, formed as leg springs 34 in this case, are provided between the stirring members 32 and the stirring member carrier 30, said spring devices indirectly connected to the stirring member carrier 30 via the shaft hub 33, wherein the shaft hub comprises locking receivers 36 for the form-fitting connection with free leg ends 35 of the leg springs 34, locking extensions 37 formed at the leg ends 35 being locked into said locking receivers 36. The leg springs 34 are integrally formed at the stirring members 32 in this case, wherein a material-fitting linking of the leg springs 34 is formed at the stirring members 32 in the case of this embodiment in that the stirring members 32 are produced in an injection molding process together with the leg springs 34. In the pre-tensioned state, the leg springs are s-shaped.

The leg springs 34 are formed, like the stirring members 32 and the shaft hub 33, out of an electrically conductive plastic material analog to the stirring member carrier 30.

Figure 2:
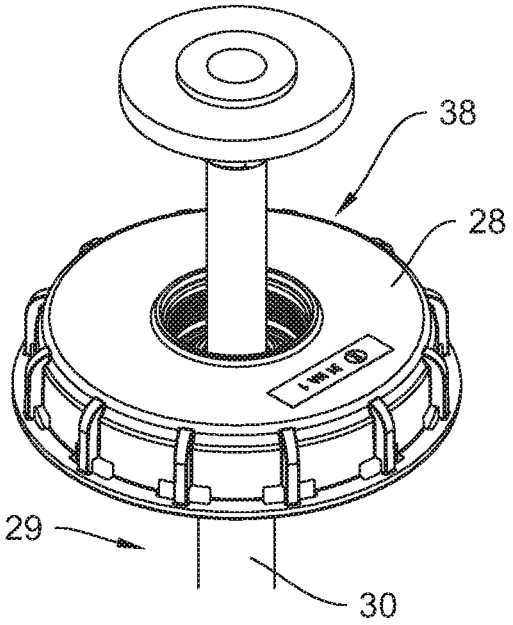
FIG. 2 shows a partial view of an upper axial end of the stirring rod arrangement of FIG. 1 having an inserted stirring mechanism shaft.
Figure 5:
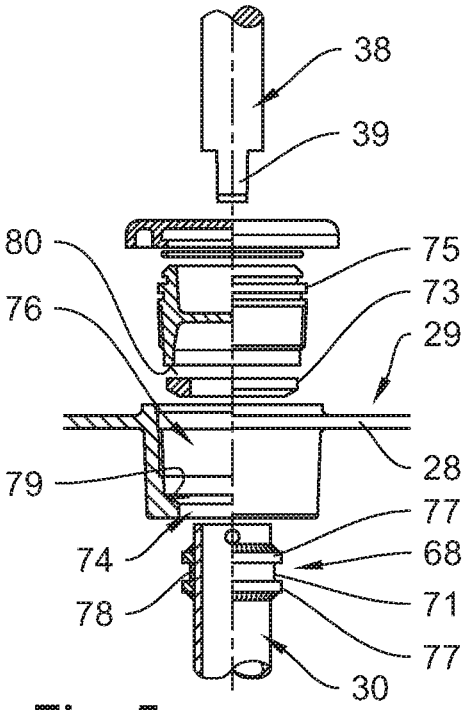
FIG. 5 shows an explosive view of another embodiment of the stirring rod arrangement not according to the invention.
Figure 9:
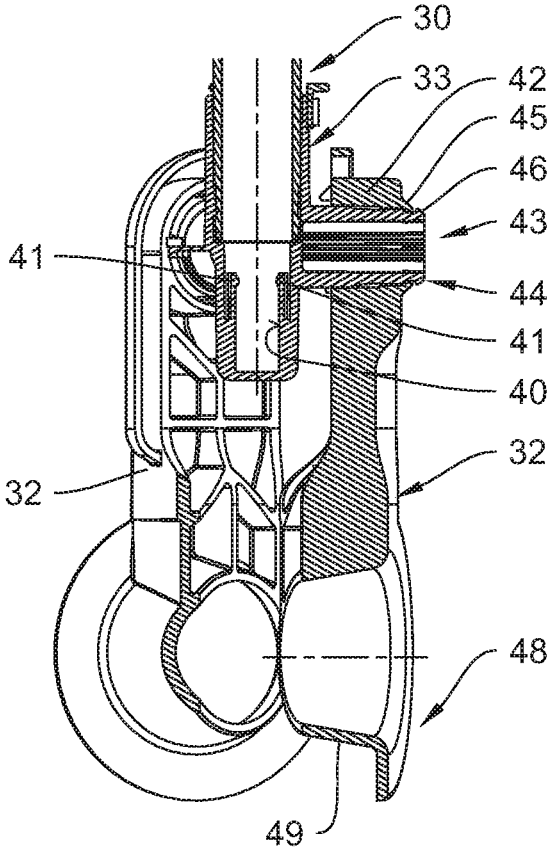
FIG. 9 shows the arrangement of stirring members illustrated in FIG. 8 in a cross sectional view according to cutting line IX-IX.
Figure 12:
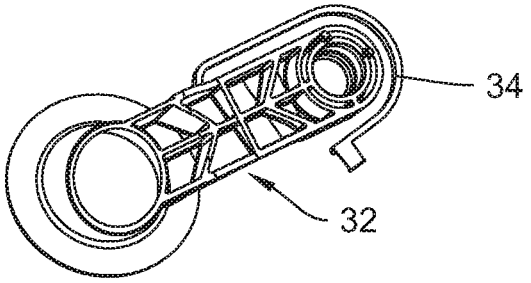
FIG. 12 shows an isometric view of the stirring member illustrated in FIG. 11 in a rear view.

In FIGS. 1 and 8, the stirring rod arrangement is illustrated in a mounting configuration, in which a rotation of the stirring member carrier 30 is not carried out by means of a stirring mechanism shaft 38 connected rotationally rigid to the stirring member carrier 30 via the shaft hub 33, said stirring mechanism shaft 38, as illustrated in FIG. 2, being inserted from the top into the stirring member carrier 30 and inserted into the shaft pin receiver 40, illustrated in FIG. 9, formed in the shaft hub 33 with a shaft pin 39, illustrated in FIG. 5, formed at the lower axial end of the stirring mechanism 38. In order to axially secure the turning-moment transferring connection between the stirring mechanism shaft 38 and the shaft hub 33, the shaft pin receiver 40 is provided with locking legs 41 which lock into locking recesses not further illustrated at the shaft pin 39.

As in particular a synopsis of FIGS. 9 and 10 shows, the stirring members 32, having bearing ends 42 formed as a bearing eye in this case for forming a pivot bearing 43, are each arranged on a pivot pin 44 formed at the shaft hub 33. The axial securing of the bearing ends 42 on the pivot pins 44 is carried out via a form-fitting connection in such a way that a locking collar 45 formed at the bearing ends 42 engages on the pivot pins 44 behind a locking collar 46 of the pivot pins after positioning of the stirring members 32.

As a comparison of FIGS. 8 and 10 illustrates, the stirring members 32 are conveyed into a pivoted position dependent on the rotational speed of the stirring member carrier 30 against the resetting spring force of the leg springs 34 with a stirring angle $\delta$ formed with respect to the rotational axis 47 in such a way that the stirring member ends 48 are arranged in a stirring distance r to the rotational axis 47, said stirring distance r being proportional to the stirring angle $\delta$ and to the rotational speed of the stirring mechanism shaft, respectively, when the stirring rod arrangement 29 is in an operational configuration, in which the stirring member carrier 30 rotates about a rotational axis 47 in consequence of a rotation drive of the stirring mechanism shaft 38 coupled to the stirring member carrier 30 via the hollow shaft 33.

Figure 13:
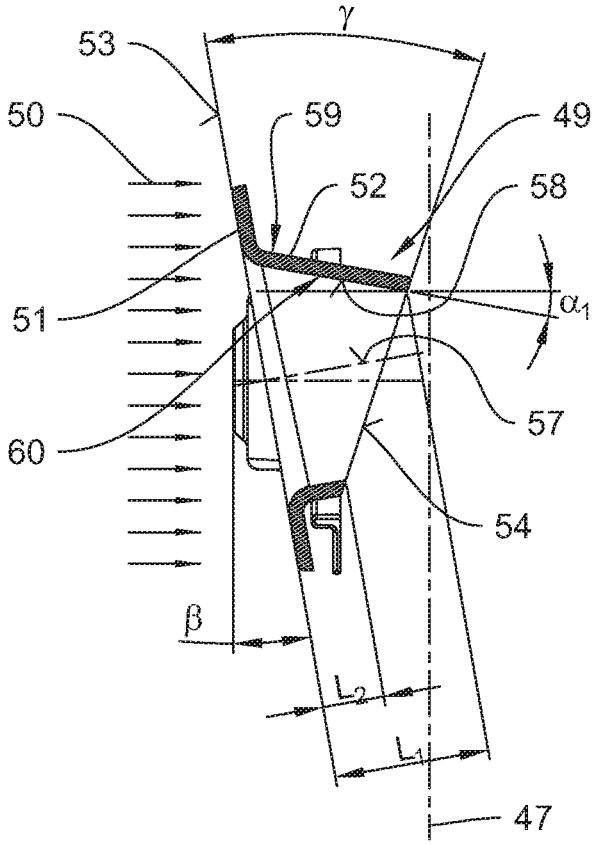
FIG. 13 shows the stirring member illustrated in FIG. 11 in a cross sectional view according to cutting line XIII-XIII.

As in particular a synopsis of FIGS. 9, 11 and 13 shows, the stirring member ends 48 are formed with a flow tube provided with an annular accumulating surface 51 at the flow inlet cross section 53, thus at the side pointing towards the inflow direction 50 during the stirring process. The accumulating surface 51 is inclined in the inflow direction 50 at an accumulating surface angle $\beta$ with respect to the rotational axis 47. The flow tube 49 comprises a tube wall 52 which is formed as a slanted cone in such a way that the flow inlet cross section 53 is inclined by a tube angle $\gamma$ towards a flow outlet cross section 54 of the flow tube 49. Wherein, as illustrated in FIG. 13, the length $L_1$ of the tube wall in the flow direction 50 in a cut perpendicular to the longitudinal axis 55 (FIG. 11) of a link 56 connecting the bearing end 42 of the stirring member 32 to the stirring member end 48 above a tube axis 57 is larger than the length $L_2$ of the tube wall 52 underneath the flow axis 57.

As further shown in FIG. 13, a surface base 58 of a concave lift surface 60 formed by an upper part 59 of the tube wall 52 is inclined at an angle of attack $\alpha$ towards the inflow direction 50.

Figure 14:
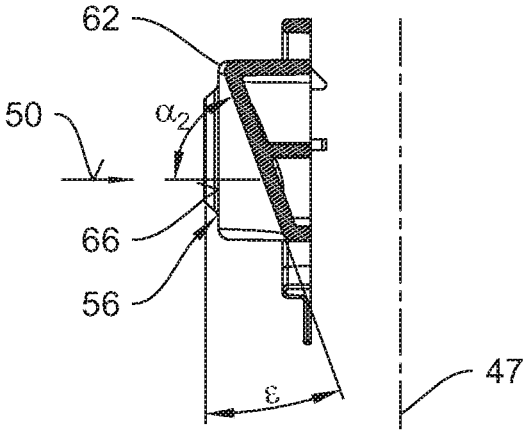
FIG. 14 shows the stirring member illustrated in FIG. 11 according to cutting line XIV-XIV.
Figure 15:
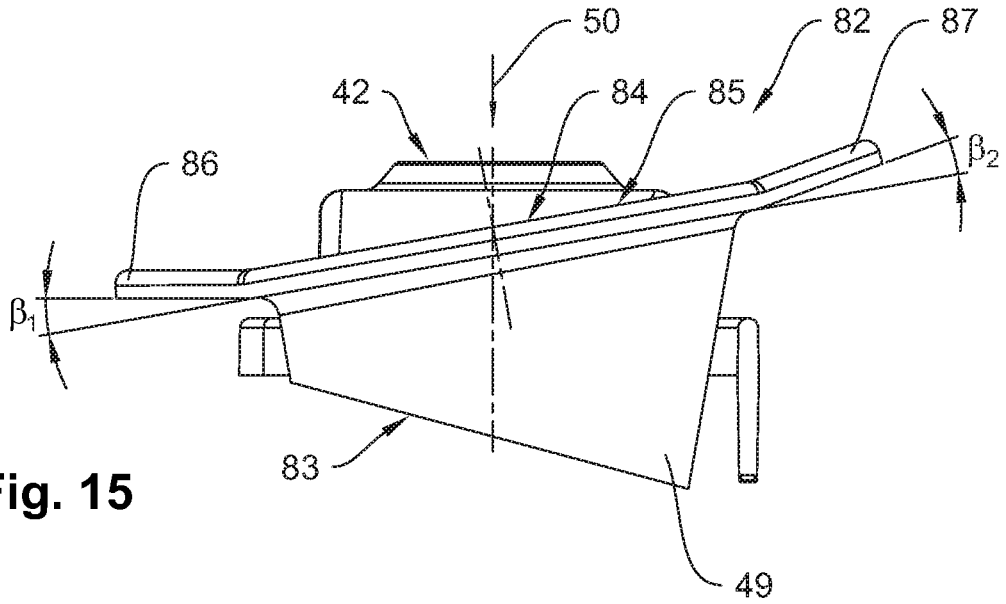
FIG. 15 shows another embodiment of a stirring member not according to the invention in side view.
Figure 16:
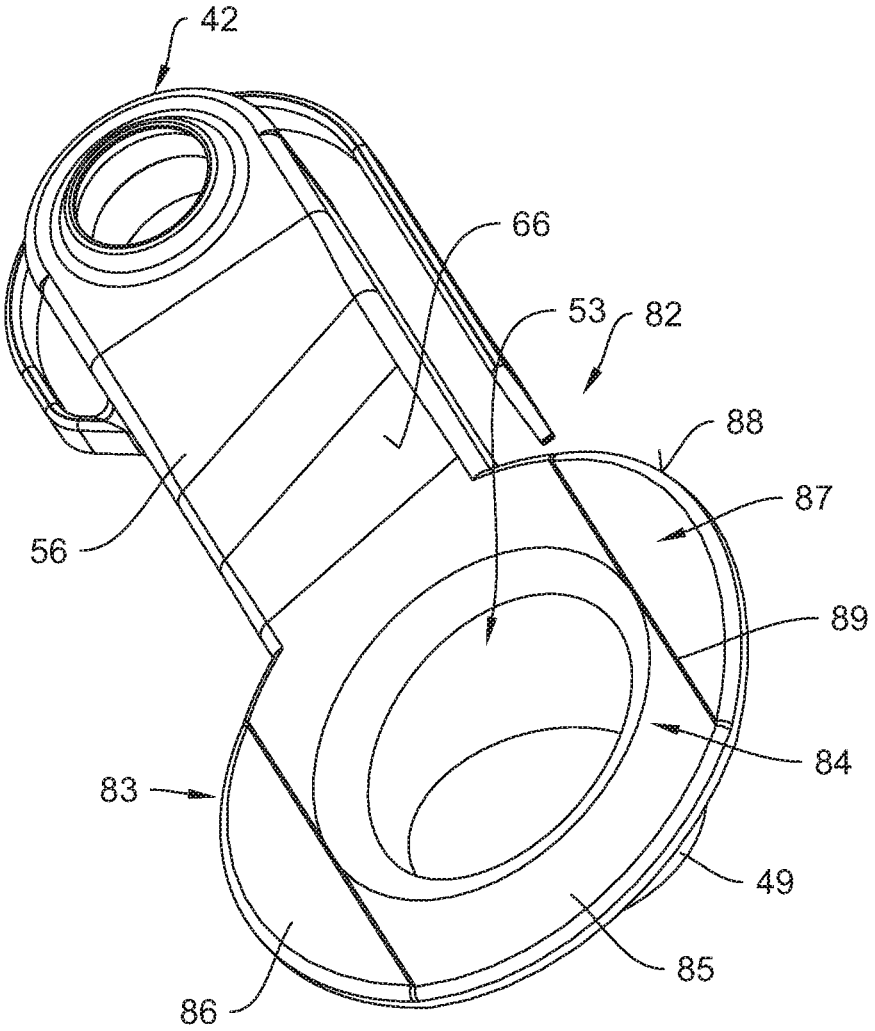
FIG. 16 shows the stirring member illustrated in FIG. 15 in isometric view.

A stirring member 82 is illustrated in FIGS. 15 and 16 which, in contrast to the stirring member 32 illustrated in particular in FIGS. 13 and 14, comprises a stirring member end 83 which, in contrast to the stirring member end 48 of the stirring member 82, is provided with an accumulating surface 84 which is assembled from a level partial surface 85 having surface segments 86 and 87 formed at the circumferential edge of the accumulating surface 84, wherein the surface segments 86, 87 are inclined against the inflow direction 50 by a surface segment angle $\beta_1$ or $\beta_2$, respectively, with respect to the level partial surface 85 in the case at hand.

As in particular FIG. 16 shows, the surface segments 86, 87 are formed as circular ring segments, wherein an outer edge 88 of the surface segments 86, 87 each tangentially passes through the circumferential edge of the accumulating surface 84 and a connecting edge 89 of the surface segments 86, 87 in the transition to the partial surface 85 extends tangientially to the flow inlet cross section 53 of the flow tube 49 of the stirring member end 83, wherein the connecting edges 89 run parallel to each other in the case at hand.

The two surface segments are formed levelly in the embodiment illustrated and further comprise a conforming size in the case at hand.

Apart from the stirring member end 83, which comprises the accumulating surface 84 instead of the accumulating surface 51, the stirring member 82 illustrated in FIGS. 15 and 16 is formed identical to the stirring member 32 illustrated in FIGS. 13 and 14, so that conformingly formed components of the stirring member 82 comprise correspondingly conform reference numerals.

As in particular a synopsis of FIGS. 11 and 14 shows, a lift pocket 61 is formed in a middle link section of the link 56 in such a way that starting from an essentially straight inflow edge 62 of the link 56, a lift surface 63 inclined by the angle of inclination a with respect to the rotational axis 47 and an angle of attack $\alpha_2$ with respect to the inflow direction 50 is formed, said lift surface 63 being lowered with respect to the adjacent link surface 66 via inclined flanks 64, 65 slanted with respect to the lift surface 63.

Figure 4:
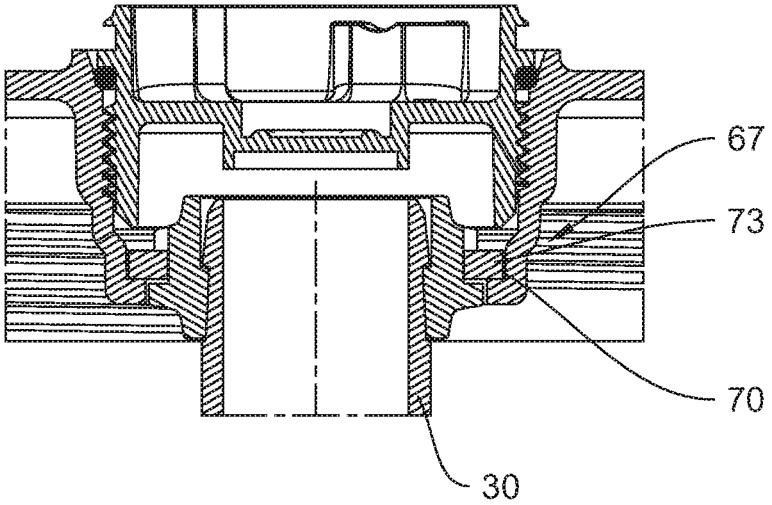
FIG. 4 shows the stirring rod arrangement shown in a transport state in FIG. 1 in an enlarged partial cross sectional view.
Figure 6:
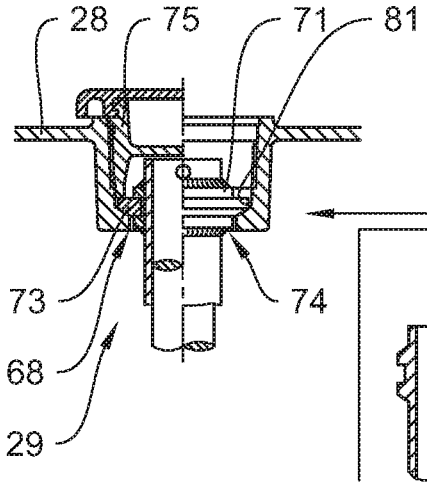
FIG. 6 shows the stirring rod arrangement illustrated in FIG. 5 in a mounted state.
Figure 7:
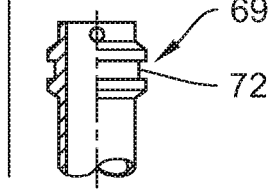
FIG. 7 shows an alternative embodiment of a connecting device formed at the upper axial end of the stirring rod arrangement.

As is in particular illustrated in FIGS. 4 to 7, the stirring member carrier 30 of the stirring rod arrangement 29 is provided with connecting devices 67, 68 and 69, illustrated in three different embodiments, at the upper axial end, said connecting devices 67, 68 and 69 receiving a, in this case, conformingly formed circlip 73 in differently formed circlip receivers 70, 71, 72. FIGS. 4 and 6 show the connecting devices 67 and 68 in the transport state of the stirring rod arrangement 29. As can be particularly seen from the connecting device 68 illustrated in a part sectional view in FIG. 5, the connecting device 68 serves for connecting the stirring member carrier 30 of the stirring rod arrangement 29 to the lid 28. Therefor, the stirring member carrier 30 illustrated in FIGS. 5 and 6 comprises a circlip receiver 71 formed as a socket and welded to the upper axial end of the stirring member carrier 30. For mounting, the upper axial end of the stirring member carrier 30 is inserted with the circlip receiver 71 formed thereon from the bottom through a insertion opening 74 formed in the lid 28, so that subsequently the circlip 73 can be inserted from the top into a plug depression 76 formed in the lid for receiving a drum plug 75 and can be locked onto the circlip receiver 71, which comprises a receiving groove 78 limited by two collar links 77. This results in a relative arrangement between the lid 28 and the connecting device 68 in which the circlip 73 abuts to a supporting edge 79 limiting the insertion opening in the bottom of the lid 28, so that the circlip 73 forms an axial abutment against the supporting edge 79.

If the drum plug 75 is now screwed into the plug depression 76 of the lid 28, a lower edge 80 of the drum plug 75 now limits a ring receiving space 81 together with the supporting edge 79 of the lid 28, in which the circlip can carry out a limited or essentially no axial movement, if anything, so that a secure connection between the lid 28 and the stirring member carrier 30 is formed.

Figure 3:
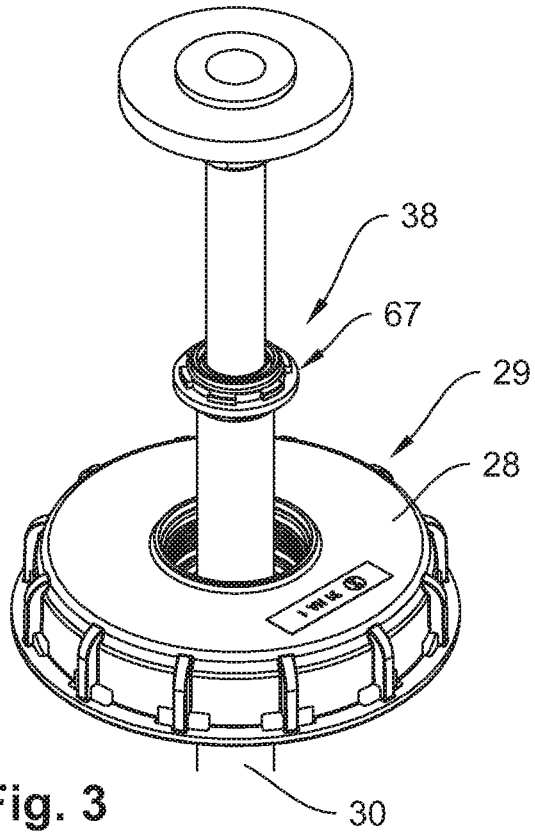
FIG. 3 shows the stirring rod arrangement illustrated in FIG. 2 having an axially elevated stirring mechanism shaft.

In this way, the container 20 can be combined with a stirring rod arrangement 29 independent of the installation of a stirring mechanism as well. If a stirring mechanism is to be connected to the stirring rod arrangement 29 in order to mix a liquid received in the container, it will suffice to remove the drum plug 75 from the plug depression 76 of the lid 28 and to insert the stirring mechanism shaft 38 into the stirring member carrier 30 from above and to couple the two. Thereby the stirring mechanism can be set on and connected to the container 20 or a support structure connected to the outer jacket of the container 20, respectively, as usual. Preferably, a slight axial lifting of the stirring member carrier 30 out of the container 20 is carried out, as illustrated by way of example in FIG. 3, in order to prevent a physical contact between the circlip 73 and the supporting edge 79 of the lid 28 while the stirring member carrier 30 is driven to rotate by means of the stirring mechanism shaft 38 and thereby preventing the forming of contact abrasions which can possibly contaminate the liquid.

Figure 17:
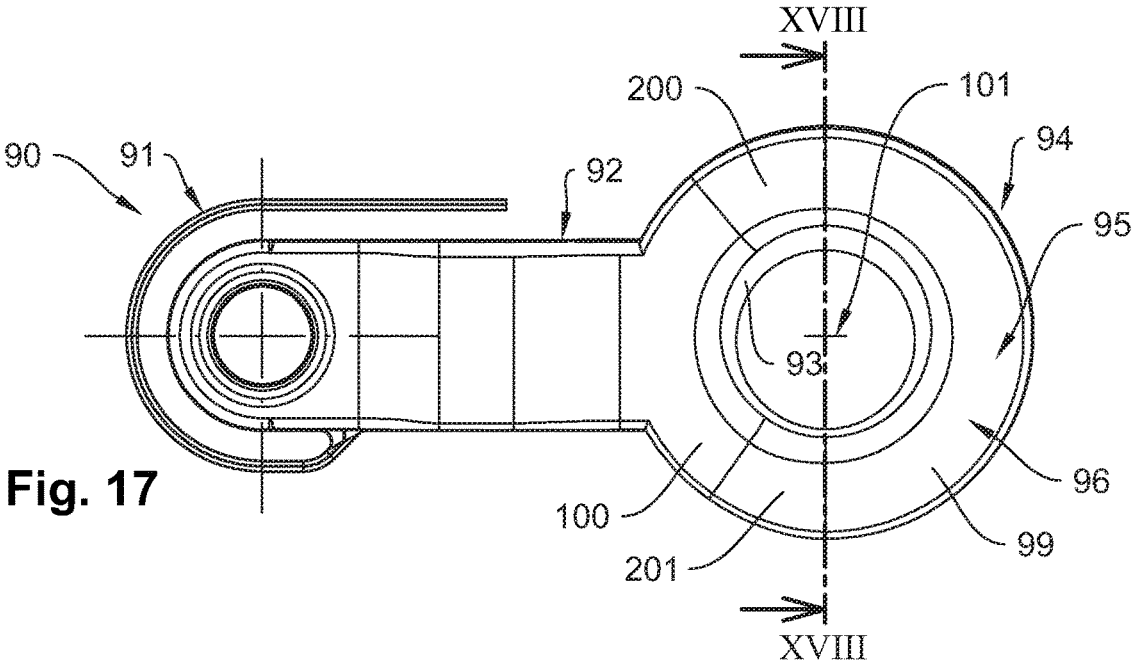
FIG. 17 shows a first embodiment of a stirring member according to the invention in top view.
Figure 19:
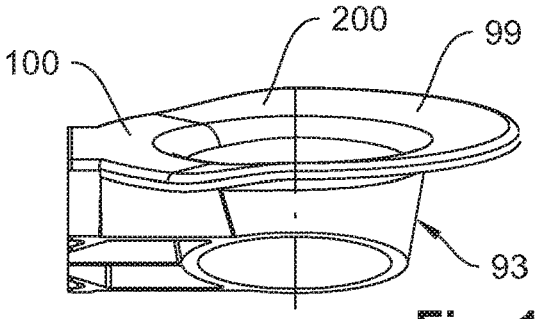
FIG. 19 shows an isometric view of the stirring member illustrated in FIG. 17.

A synopsis of FIGS. 17 and 19 shows a first embodiment of a stirring member 90 according to the invention having a bearing end 91 and a stirring member end 94 connected to the bearing end 91 via a link 92 and having a flow tube 93. The stirring member 90 can be connected to a rod-shaped stirring member carrier of the stirring rod arrangement not illustrated here. The flow tube 93 comprises a tube wall 128, wherein the flow tube 93 comprises an circularly formed accumulating surface 95 at the flow inlet cross section, and wherein the accumulating surface 95 comprises at least one circular ring sector 96 which is inclined with respect to an inflow plane 97 of the flow inlet cross section 98. Consequently, in contrast to the stirring members described in FIGS. 1 to 16, the stirring member 90 comprises the circular ring sector 96 at the circularly shaped accumulating surface 95, the circular ring sector 96 being tilted at a constant surface sector angle ζ of 10° in the area of a surface sector 99 of the circular ring sector 96 with respect to the inflow plane 97 of the flow inlet cross section 98. The surface sector 99 of the accumulating surface 95 formed in this manner is consequently inclined at this constant surface sector angle ζ with respect to a level partial surface 100 of the accumulating surface 95. The partial surface 100 directly abuts to the link 92. The surface sector 99 extends over 180° based on an circular ring center 101 of the accumulating surface 95. Additionally to the surface sector 99 (having the constant surface sector angle ζ), the circular ring sector 96 comprises two intermediate sectors 200, 201, wherein the surface inclination angle ζ increases nearly linearly from 0° (adjacent to the partial surface 100) to 10° (adjacent to the surface sector 99) in the circumferential direction in each of the intermediate sectors. Both of the intermediate sectors 200, 201 each extend over approximately 45° in the circumferential direction, in total therefore 90°.

Figure 20:
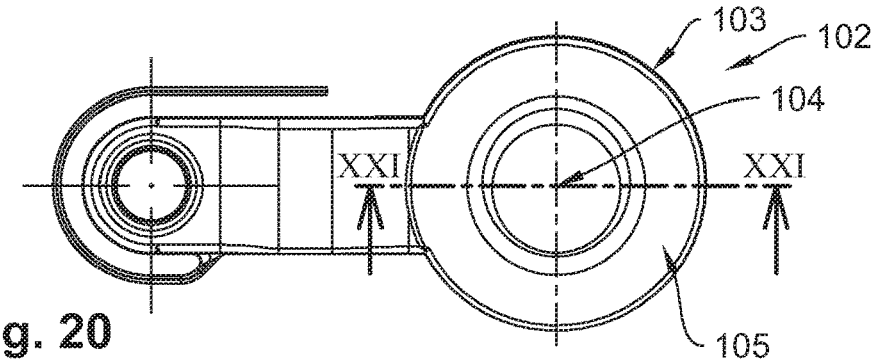
FIG. 20 shows a second embodiment of an individual stirring member according to the invention in top view.
Figure 21:
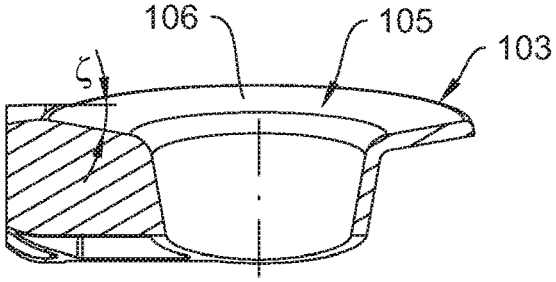
FIG. 21 shows the stirring member illustrated in FIG. 20 in sectional view according to cutting line XXI-XXI.

FIGS. 20 and 21 show a second embodiment of a stirring member 102 according to the invention. In particular in contrast to the stirring member described in FIGS. 17 to 19, the stirring member 102 comprises an circular ring sector 103, in contrast to the stirring member illustrated in FIGS. 17 to 19, formed in such a way that it extends over 360° of an accumulating surface 105 based relatively on an circular ring center 104. The circular ring sector 103 therefore forms a cone 106. The inclined surface sector angle ζ is formed constant here as well, namely in the circumferential direction and in the radial direction, each based on the circular ring center 104.

Figure 18:
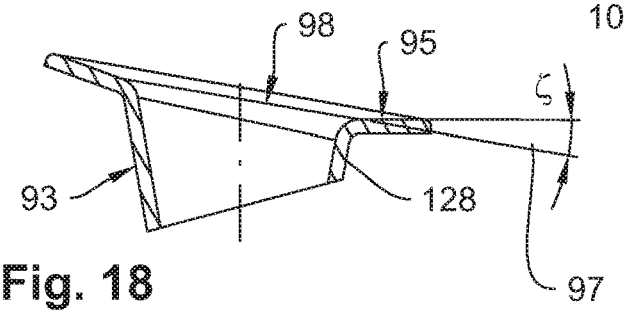
FIG. 18 shows the stirring member illustrated in FIG. 17 in sectional view according to cutting lint XVIII-XVIII.
Figure 22:
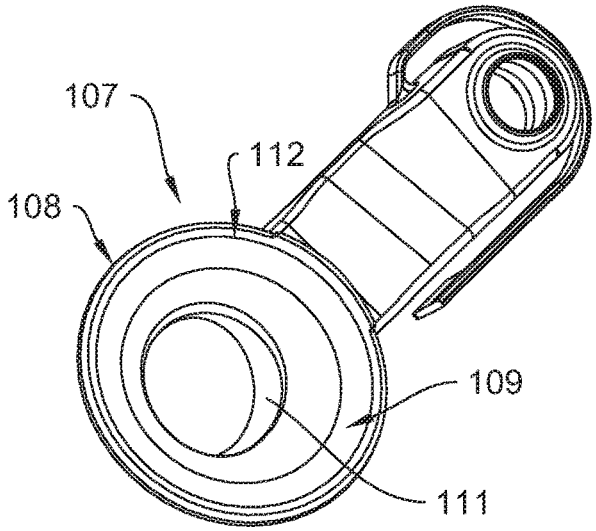
FIG. 22 shows a third embodiment of an individual stirring member according to the invention in isometric view.
Figure 23:
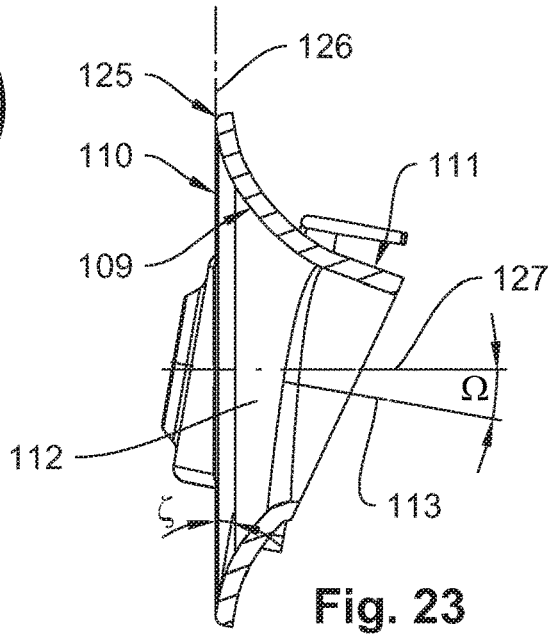
FIG. 23 shows a stirring member end of the stirring member illustrated in FIG. 22 in cross sectional view.
Figure 24:
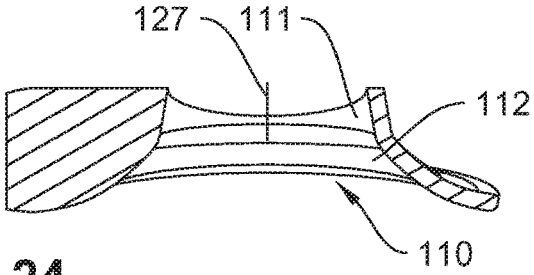
FIG. 24 shows the stirring member end of the stirring member illustrated in FIG. 23 in longitudinal sectional view.

A synopsis of FIGS. 22 to 24 shows a third embodiment of a stirring member 107 according to the invention, wherein, in contrast to the stirring member described in FIGS. 17 to 19, the stirring member 107 comprises a stirring member end 108 having a trumpet-shaped accumulating surface 109. Starting from an outer edge 125 and based on an outer edge plane 126 of the accumulating surface 109, the surface sector angle ζ continuously increases linearly as the distance relative to an circular ring center axis 127 or an circular ring center of the accumulating surface 109 decreases. The accumulating surface 109 forms a bell-shaped opening 110 having a surface sector angle ζ of at least 10°. The accumulating surface 109 merges into a flow tube 111. An circular ring 112 of the accumulating surface 109 is inclined at an angle Ω relative to a flow direction 113 of the flow tube 111. Therefore, a tube wall 129 of the flow tube 111 essentially extends in the inflow direction or is inclined in the inflow direction by said angle Ω.

Figure 25:
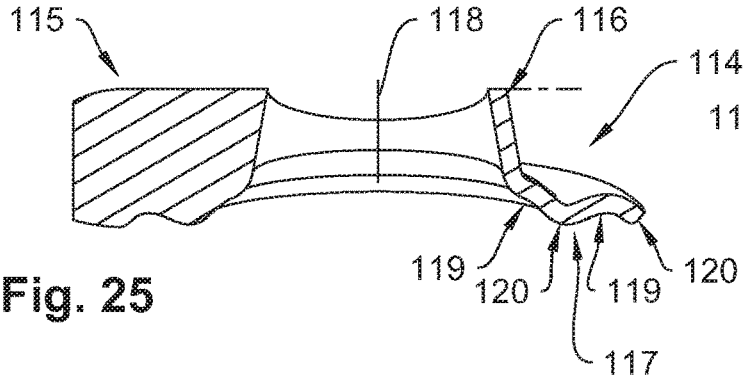
FIG. 25 shows a fourth embodiment of a stirring member end according to the invention in longitudinal sectional view.
Figure 26:
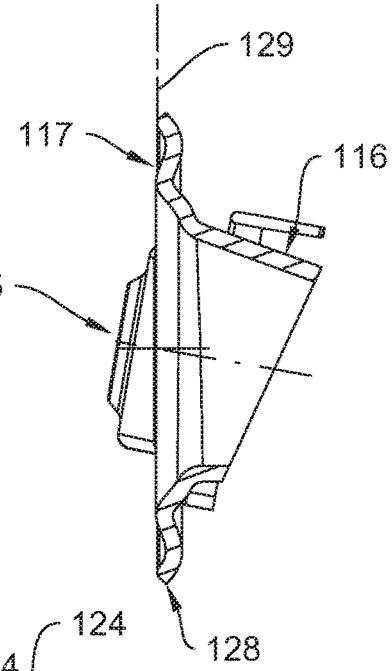
FIG. 26 shows a cross sectional view of the stirring member end from FIG. 25.

FIGS. 25 and 26 show a stirring member end 114 of an only partially illustrated fourth embodiment of a stirring member 115 according to the invention having a flow tube 116 and an circularly formed accumulating surface 117. In contrast to the stirring member described in FIGS. 17 to 19, the stirring member 115 and the accumulating surface 117, respectively, are formed continuously wavelike based on an circular ring center axis 118 or an circular ring center 118 of the accumulating surface 117, respectively, according to a sine function. Thus, the accumulating surface 117 forms concentric wave crests 119 and wave troughs 120. Thereby, originating from an outer edge 128 and based on an outer edge plane 129 of the accumulating surface 117, the surface sector angle ζ continuously increases and decreases in turn as the distance relative to the circular ring center axis 118 decreases. The surface sector angle ζ is therefore continuously changed with a decreasing distance of the accumulating surface 117 relative to the circular ring center 118 according to a non-linear, trigonometric function.

Figure 27:
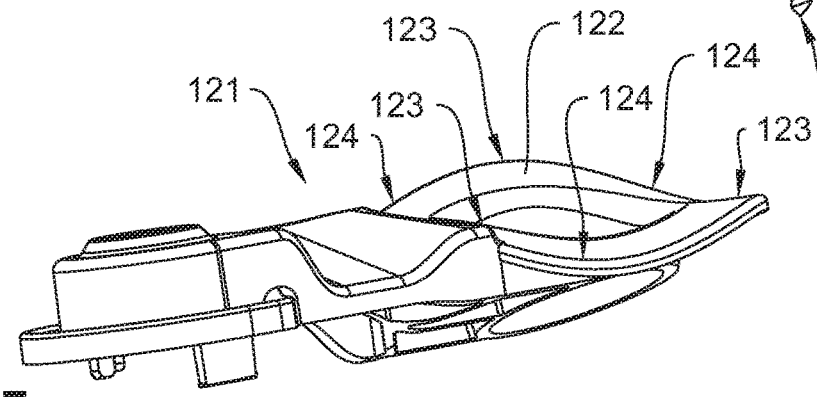
FIG. 27 shows a fifth embodiment of an individual stirring member according to the invention in isometric view.

FIG. 27 shows another stirring member 121 according to the invention in an embodiment in which, in contrast to the stirring member described in FIGS. 17 to 19, an accumulating surface 122 is inclined and an inclination, or more specifically a surface sector angle ζ not illustrated, of 10° along the accumulating surface 122 continuously changes according to a sine function in such a way that the accumulating surface 122 forms a wave in the radial direction. The accumulating surface 122 also comprises wave crests 123 and wave troughs 124. The surface sector angle ζ is therefore continuously changed according to a non-linear, trigonometric function along the accumulating surface 122 or rather an circular ring sector.

The invention claimed is:

1. A stirring rod arrangement for connecting to a stirring mechanism of an industrial stirrer and combinable with a container (20) for receiving liquids, wherein the container comprises a filling opening closable with a lid (28) for filling the container in an upper bottom wall (26), wherein the stirring rod arrangement comprises a rod-shaped stirring member carrier (30) formed as a hollow shaft for receiving a stirring mechanism shaft (38), characterized in that the stirring rod arrangement comprises stirring members (32, 82) pivotably connected to the stirring member carrier, wherein the stirring members comprise a bearing end (91) and a stirring member end (94, 108, 114) connected to the bearing end via a link (92) and having a flow tube (93, 111, 116), wherein the flow tube comprises a tube wall (128, 129) characterized in that the flow tube comprises an annularly formed accumulating surface (95, 105, 109, 117, 122) with an outer edge at its flow inlet cross section (98), wherein the accumulating surface comprises at least one circular ring sector (96, 103) which is inclined with respect to an inflow plane (97) of the flow inlet cross section.

2. The stirring rod arrangement according to claim 1, characterized in that the inclined circular ring sector (96, 103) extends over at least 90°, preferably at least 180°, particularly preferably at least 270°, of the accumulating surface (95, 105, 109, 117, 122) with respect to an circular ring center (101, 104, 118).

3. The stirring rod arrangement according to claim 2, characterized in that the accumulating surface (95) comprises at least one surface sector (99) which is inclined at a surface sector angle ζ with respect to a level partial surface (100) of the accumulating surface, wherein the surface sector angle ζ is 5° to 20°, preferably 10°.

4. The stirring rod arrangement according to claim 1, characterized in that the inclined circular ring sector (103) extends over more than 360° of the accumulating surface (105, 109, 117, 122) based relatively on an circular ring center (101, 104, 118, 127).

5. The stirring rod arrangement according to claim 1, characterized in that the circular ring sector (96, 103) is inclined at a surface sector angle ζ, wherein the surface sector angle is consistent.

6. The stirring rod arrangement according to claim 2, characterized in that the circular ring sector (96, 103) is inclined at a surface sector angle ζ, wherein the surface sector angle is continuously changed along the circular ring sector regarding a non-linear, preferably trigonometric, function.

7. The stirring rod arrangement according to claim 2, characterized in that the circular ring sector is inclined at a surface sector angle ζ, wherein the surface sector angle continuously increases relative to an circular ring center (127) with decreasing distance to the accumulating surface (109).

8. The stirring rod arrangement according to claim 7, characterized in that the accumulating surface (109) is formed as a bell-shaped opening (110).

9. The stirring rod arrangement according to claim 2, characterized in that the circular ring sector is inclined at a surface sector angle ζ, wherein the surface sector angle is continuously changed relative to an circular ring center (118) with decreasing distance of the accumulating surface (117) regarding a non-linear function.

10. The stirring rod arrangement according to claim 9, characterized in that the accumulating surface (122) is formed as a wavelike opening.

11. The stirring rod arrangement according to claim 1, characterized in that a free stirring member end (48, 83) of the stirring members (90, 102, 107, 115, 121) is pivoted against a rotational axis (47) of the stirring member carrier in a mounting configuration, wherein a spring device is arranged between the stirring members (90, 102, 107, 115, 121) and the stirring member carrier in such a way that a centrifugal force is applied to the stirring members in an operational configuration in consequence of a rotation of the stirring member carrier and the stirring members take up a pivoted position, which is dependent on the rotational speed of the stirring member carrier, at a stirring angle δ formed with respect to the rotational axis, wherein the free stirring member ends are arranged at a stirring distance r from the rotational axis and the spring force acts against the centrifugal force, the spring force becoming stronger as the stirring angle increases.

12. The stirring rod arrangement according to claim 11, characterized in that the free stirring member ends (94, 108, 114) of the stirring members (90, 102, 107, 115, 121) are arranged underneath pivot bearings (43) formed at the stirring member carrier (30) in the mounting configuration.

13. The stirring rod arrangement according to claim 11, characterized in that the spring device is formed as a leg spring.

14. A transport and storage container for liquids having a container (20) formed as an internal container made of plastic, said container (20) comprising a filling opening closable with a lid (28) for filling the container in an upper bottom wall (26), as well as a lower bottom wall connecting two lateral walls (23, 24), a rear wall (25) and a front wall (22) of the container for supporting the container on a pallet floor of a transport pallet having an outer jacket for receiving the container, characterized in that the lid is provided with a stirring rod arrangement according to claim 1.

* * * * *